United States Patent [19]

Nakayama et al.

[11] Patent Number: 4,988,950

[45] Date of Patent: Jan. 29, 1991

[54] ELECTRON SYNCHROTRON ACCELERATING APPARATUS

[75] Inventors: Koichi Nakayama, Musashino; Yoshio Gomei, Yokohama, both of Japan

[73] Assignee: Kabushiki Kaisha Toshiba, Kawasaki, Japan

[21] Appl. No.: 369,073

[22] Filed: Jun. 21, 1989

[30] Foreign Application Priority Data

Jun. 21, 1988 [JP] Japan ..... 63-152828

[51] Int. Cl.[5] ..... H05H 7/08; H05H 13/04

[52] U.S. Cl. ..... 328/235; 328/234; 328/236

[58] Field of Search ..... 328/234, 235, 236; 313/62

[56] References Cited

U.S. PATENT DOCUMENTS 4,623,847 11/1986 Anderberg et al. ..... 328/234

FOREIGN PATENT DOCUMENTS 0239646 10/1987 European Pat. Off. .
0260324 3/1988 European Pat. Off. .

OTHER PUBLICATIONS

Nuclear Instruments & Methods in Physics Research, vol. 200, Nos. 2/3, Sep. 1982, pp. 475–479, North Holland Publishing Co., Amsterdam, NL; U. Trinks et al.: "The Table-Top Synchrotron Radiation Source Klein ERNA".

Nuclear Instruments & Methods in Physics Research/-Section B, vol. B24/25, part I, Apr. 3rd, 1987, pp. 425–428, Elsevier Science Publishers B.V. (North Holland Physics Publishing Division), Amsterdam, NL; N. Takahashi: "Compact Superconducting SR Ring for X-Ray Lithography".

*Primary Examiner*—Kenneth Wieder

*Attorney, Agent, or Firm*—Oblon, Spivak, McClelland, Maier & Neustadt

[57] ABSTRACT

An electron synchrotron accelerating apparatus comprises an accelerating ring, superconducting magnets for applying deflecting magnetic fields inside the accelerating ring, and an electron injector for injecting low-energy electron beams of 40 MeV or less into the accelerating ring. The low-energy electron beams of 40 MeV or less are injected a plurality of times for each predetermined period of time, by means of the electron injector. Inventors hereof find that the radiation damping time is shorter than the beam lifetime, even though the energy of the injected electron beams is relatively low. Accordingly, the electron beams can be injected a plurality of times before the lifetime of the injected beams terminates. Even though the energy of the injected electron beams is relatively low, therefore, accumulated electron current can be increased to a predetermined value. Thus, electronic synchrotron apparatus is provided which can produce a predetermined amount of synchrotron orbit radiations despite its compactness.

5 Claims, 4 Drawing Sheets

ELECTRON SYNCHROTRON ACCELERATING APPARATUS

BACKGROUND OF THE INVENTION

1. Field of the Invention

The present invention relates to an electron synchrotron accelerating apparatus, and more particularly, to an electron synchrotron accelerating apparatus for producing synchrotron orbit radiation and a method for operating the accelerating apparatus.

2. Information of the Related Art

Presently, x-ray exposure apparatuses of one type are becoming prevailing means for manufacturing semiconductors. These apparatuses can very finely transfer circuit pattern lines to wafers. In the exposure apparatuses of this type, an electron synchrotron accelerating apparatus is sometimes used as an x-ray generating apparatus, in order to generate strong x-ray with good parallelism. In the synchrotron accelerating apparatus, synchrotron orbit radiation is produced when electrons running along an orbit are deflected by magnetic fields. Soft x-ray of the orbit radiation are utilized as exposure light beams.

In the synchrotron accelerating apparatus arranged in this manner, electron beams are preliminarily accelerated and injected into an accelerating ring by means of an electron injector. These electron beams are rotated along a predetermined orbit inside the ring by deflecting magnetic fields, and are then accelerated to a rated energy level by means of a high-frequency accelerating cavity.

The electron beams are injected, in a predetermined amount (enough for a number of revolutions inside the accelerating ring) for each cycle, into the accelerating ring. This system of injection is called a multi-turn injection mode. An injection equilibrium orbit and a central orbit are defined within the accelerating ring. Each injected electron beam first rotates along the injection equilibrium orbit, while undergoing betatron oscillation around the injection equilibrium orbit. The amplitude of the betatron oscillation of the electron beam, which is great at this point of time, is subjected to gradual radiation damping. As a pulse magnetic field is reduced gradually, the injection equilibrium orbit approaches and finally overlaps the central orbit. The electron beam stably moves along the central orbit, and the amplitude of the betatron oscillation is subjected to gradual radiation damping. The time period required until the amplitude of the betatron oscillation of the electron beam reaches 1/e is called radiation damping time $\tau_d$.

The injection of the electron beam is repeated a plurality of times for nearly each radiation damping time $\tau_d$. More specifically, after a previously injected electron beam is damped and stabilized, a subsequent electron beam is injected into the accelerating ring. Thus, the electron beams are accumulated on the central orbit, thereby providing accumulated electron current. When the accumulated electron current is accelerated and deflected, synchrotron orbit radiation is produced. In order to increase the radiation, therefore, the flow of the accumulated electron current must be made large. The higher the frequency of the beam injection, the larger the accumulated electron current flow will be made. This system of repeated beam injection is called a multi-cycle injection mode.

The electron beams accumulated on the central orbit are changed from the phase for the stable acceleration, due to collisions with the electron beams each other, and dissipate at a certain probability. The time interval of dissipation of each electron beam is called beam lifetime $\tau_T$. Thus, the electron beams must have been injected by the end of the beam lifetime. If radiation damping time $\tau_d$ and beam lifetime $\tau_T$ are 100 seconds and 1,000 seconds, respectively, the electron beams theoretically can be injected about ten times (1000/100 =10).

If the synchrotron accelerating apparatus is used as the exposure apparatus, it is expected to be compact. To attain this, an injector is utilized which can inject electron beams of relatively low energy of, e.g., 10 to 40 MeV into the accelerating ring.

An electromagnet for generating a deflecting magnetic field inside the accelerating ring is formed of a normal conducting magnet. The intensity of the maximum deflecting magnetic field of the normal conducting magnet is about 1.5 T. Since the field intensity is low, the circumference and deflection radius of the accelerating ring is made relatively long. If electron beams of relatively low energy of, e.g., 10 to 40 MeV are injected into the ring, radiation damping time $\tau_d$ is as long as several minutes to tens of minutes. If the accumulated electron current is 500 mA, on the other hand, beam lifetime $\tau_T$ is substantially equal to radiation damping time $\tau_d$ FIG. 1B shows the dependence of the beam lifetime and the radiation damping time on the injected electron energy, observed when the radius of the accelerating ring, the maximum deflecting magnetic field intensity, and the accumulated electron current are, for example, 3 m, 1.5 T, and 500 mA, respectively. As seen from FIG. 1B, if the injected electron energy is 30 MeV, beam lifetime $\tau_T$ is substantially equal to radiation damping time $\tau_d$.

Therefore, the electron beam can be injected only once into the accelerating ring, that is, multi-cycle injection is impossible. Thus, if the energy of the injected electron beam is relatively low, the accumulated electron current cannot be increased to a predetermined value. This is regarded as attributable to the low intensity of the deflecting magnetic field and the long circumference of and the long deflection radius the accelerating ring.

Accordingly, the electromagnet for applying the deflecting magnetic field in the accelerating ring may be formed of a superconducting magnet, which can generate a high-intensity magnetic field despite its compactness. Since the intensity of the deflecting magnetic field is high, in this case, the circumference and the deflection radius of the ring can be made shorter than when a normal conducting magnet is used. Thus, radiation damping time $\tau_d$ can be expected to be made shorter than beam lifetime $\tau_T$.

No researchers have studied the relationship between radiation damping time $\tau_d$ and beam lifetime $\tau_T$ in the case where a deflecting magnetic field is applied by means of a superconducting magnet, and electron beams of relatively low energy of, e.g., 10 to 40 MeV are applied to an accelerating ring. In this case, therefore, the possibility of multi-cycle injection of the electron beams has been unknown. Thus, whether or not the accumulated electron current can be increased to the predetermined value has not been determined yet.

SUMMARY OF THE INVENTION

The object of the present invention is to provide an electron synchrotron accelerating apparatus, in which accumulated electron current can be increased to a predetermined value even though electron beams of relatively low energy are injected into an accelerating ring by means of a compact electron injector. Thus, an electron synchrotron apparatus is provided which can produce a predetermined amount synchrotron orbit radiations despite its compactness.

According to the present invention, there is provided an electron synchrotron accelerating apparatus, which comprises: an accelerating ring; superconducting magnets for applying deflecting magnetic fields inside the accelerating ring; and an electron injector for injecting low-energy electron beams of 40 MeV or less into the accelerating ring, the electron injector being adapted to inject the electron beams a plurality of times for each predetermined period of time, wherein the radiation damping time is shorter than the beam lifetime, so that the electron beams are injected a plurality of times before the lifetime of the injected electron beams terminates, whereby the electron beams are accumulated, and accumulated electron current is increased to a predetermined value.

According to a study made by the inventors hereof, it was found that radiation damping time $\tau_d$ can be made much shorter than when normal conducting magnets are used, even though the energy of the injected electron beams is relatively low. If deflecting magnetic fields are applied inside the accelerating ring by means of the superconducting magnets, their intensity is high. Accordingly, the circumference of the accelerating ring can be shortened, so that the period during which the electron beams circulate along an injection equilibrium orbit is relatively short. Further, the energy dissipated while each electron beam makes a round along the orbit is proportional to the square of the field intensity. Thus, if the intensity of the deflecting magnetic fields is high, much energy of the electron beams dissipates during the circulation through the injection equilibrium orbit.

The short period for the electron beam circulation and the substantial energy losses of the circulating electron beams cause betatron oscillation to be damped much faster than when the normal conducting magnets are used. Even if the energy of the injected electron beams is relatively low, therefore, radiation damping time $\tau_d$ is much shorter.

According to the study made by the inventors hereof, moreover, it was found that the beam lifetime is relatively long even though the energy of the injected electron beams is relatively low. The results of the study will be described in detail later in connection with an embodiment of the present invention.

Thus, the radiation damping time is much shorter than the beam lifetime. Accordingly, the electron beams can be injected a plurality of times before the lifetime of the injected beams terminates. Even though the energy of the injected electron beams is relatively low, therefore, accumulated electron current can be increased to a predetermined value. Thus, an electron synchrotron apparatus is provided which can produce a predetermined amount of synchrotron orbit radiation despite its compactness.

DETAILED DESCRIPTION OF THE PREFERRED EMBODIMENTS

Figure 1A:
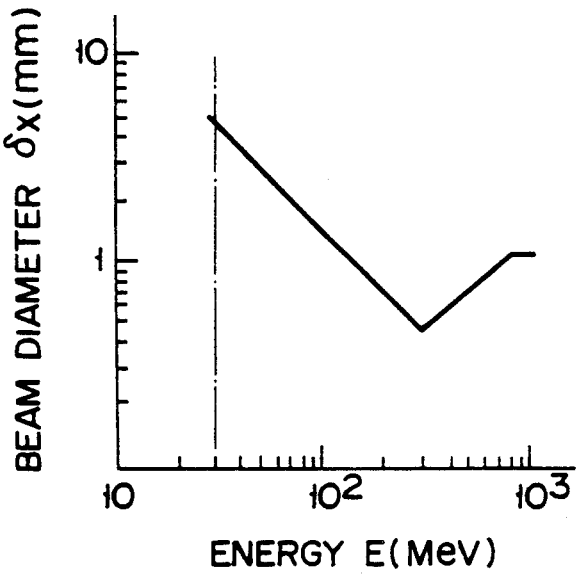
FIG. 1A (PRIOR ART)
FIG. 1A is a graph showing the dependence of the beam size on the energy of injected electrons, observed when normal conducting magnets are used as sources of deflecting magnetic fields.
Figure 1B:
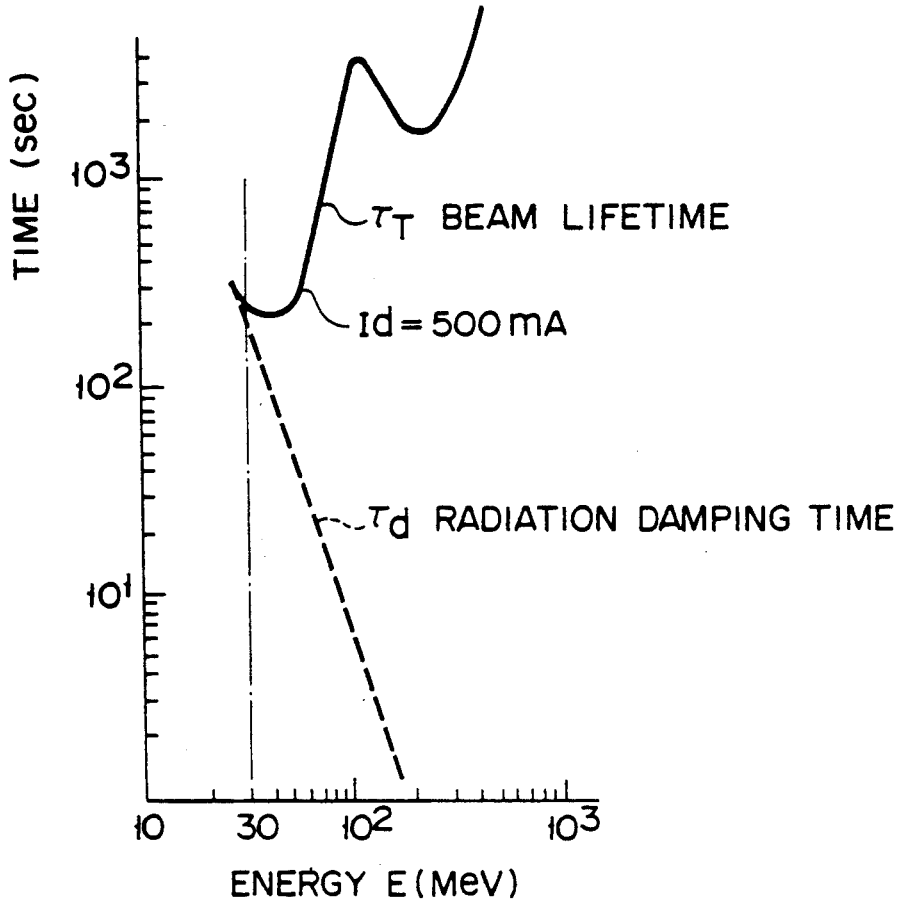
FIG. 1B (PRIOR ART)
FIG. 1B is a graph showing the dependence of the beam lifetime and the radiation damping time on the injected electron energy, observed when the normal conducting magnets are used as the sources of deflecting magnetic fields.
Figure 2A:
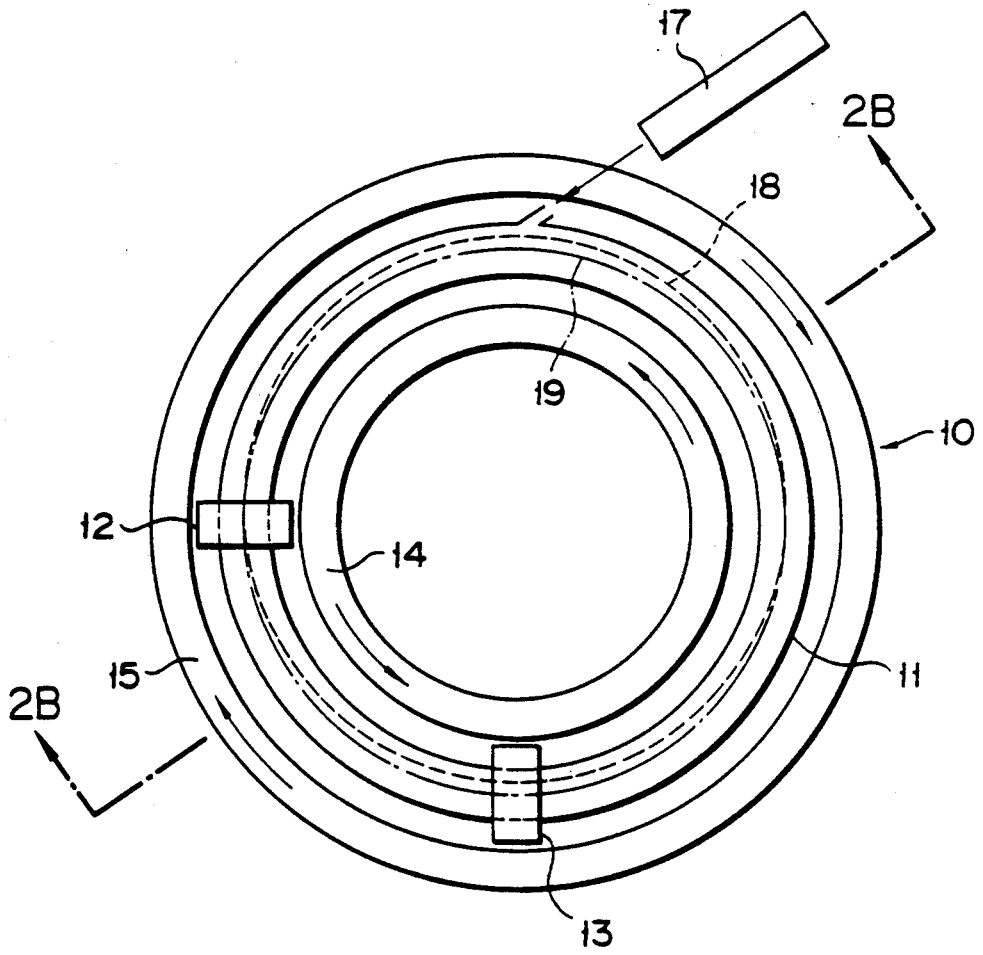
FIG. 2A is a schematic view of an electron synchrotron accelerating apparatus according to the present invention (core is not shown)
Figure 2B:
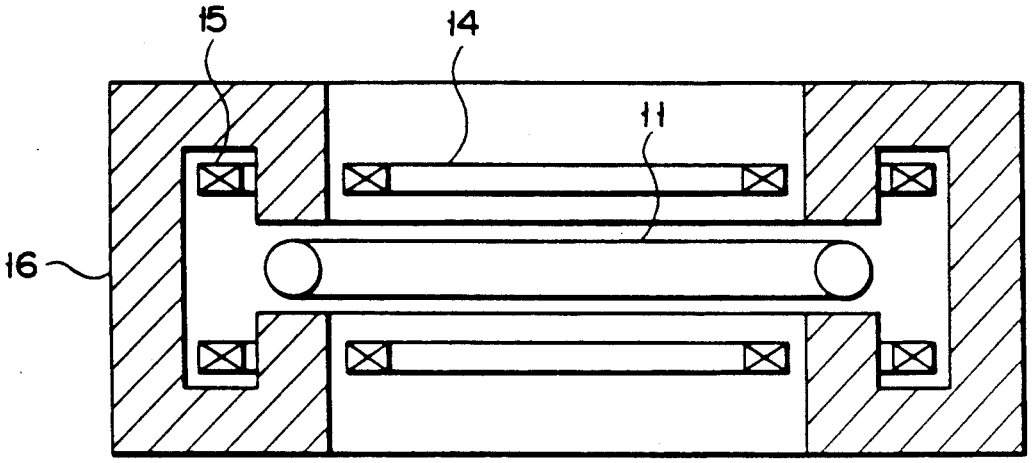
FIG. 2B is a sectional view showing an accelerating ring and a superconducting magnet of the apparatus of FIG. 2A.

FIGS. 2A and 2B show electron synchrotron accelerating apparatus 10 according to the present invention. Apparatus 10, which serves to produce synchrotron orbit radiation, is incorporated in a light source for lithography. The accelerating apparatus is provided with accelerating ring 11 with a diameter of 0.5 m. High-frequency accelerating cavity 12 is located at a predetermined position of ring 11. It serves to accelerate electron beams passing through ring 11. Pulse electromagnet 13 for generating a pulse magnetic field in accelerating ring 11 is located at a predetermined position of the ring.

Inner and outer superconducting magnets 14 and 15 are arranged on the inner and outer peripheral sides, respectively, of accelerating ring 11. They serve to apply deflecting magnetic fields inside accelerating ring 11, as indicated by arrows in FIG. 2B. Electromagnets 14 and 15 are provided with H-shaped core 16. Further, ring 11 is connected with electron injector 17, which injects electron beam into ring 11 after preliminarily accelerating the beams so that their energy is 40 MeV or less. Means for deflecting the accelerated electron beams to produce synchrotron radiation and means for guiding the radiation are not shown.

The inventors hereof made the following study of the case where superconducting magnets are used as sources of deflecting magnetic fields, and the energy of the injected electron beams is low.

First, radiation damping time $\tau_d$ was considered. Thereupon, it was found that time $\tau_d$ can be made much shorter than when normal conducting magnets are used, even through the energy of the injected electron beams is relatively low. Thus, if deflecting magnetic fields are applied inside the accelerating ring by means of the superconducting magnets, their intensity is high. Accordingly, the circumference of the accelerating ring can be shortened, so that the period during which the electron beams circulate along an injection equilibrium orbit is relatively short. Further, the energy dissipated while each electron beam makes a round along the orbit is proportional to the square of the field intensity. Thus, if the intensity of the deflecting magnetic fields is high, much energy of the electron beams dissipates during the circulation through the injection equilibrium orbit.

The short period for the electron beam circulation and the substantial energy losses of the circulating electron beams cause betatron oscillation to be damped much faster than when the normal conducting magnets are used. Even if the energy of the injected electron beams is relatively low, therefore, radiation damping time $\tau_d$ is much shorter.

Secondly, beam lifetime $\tau_T$ was considered. Thereupon, it was found that the beam lifetime is relatively long even though the energy of the injected electron beams is relatively low. The following is a description of the results of the study.

According to the conventional theory of an accelerator using normal conducting magnets as sources of deflecting magnetic fields, beam lifetime $\tau_T$ of low-energy electron beams is said to be determined by the Touschek lifetime. It is conventionally indicated, therefore, that the lower the energy of the electron beams, the shorter is the Touschek lifetime, and hence, the shorter is beam lifetime $\tau_T$.

The inventors hereof, however, found that the effect of expansion of the electron beams due to collisions thereof with one another is not accurately evaluated according to the conventional accelerator theory. Thus, they considered the case that orbital radiation with a critical wavelength of 19.4 A can be obtained with use of accelerating apparatus 10. In this case, the rated energy is 525 MeV, and the maximum deflecting magnetic field intensity is 3.5 T. Using gradient index n=0.5 of the deflecting magnetic fields and accumulated electron current of 1A, the inventors obtained the dependence of beam size $\sigma_X$, beam lifetime $\tau_T$, and radiation damping time $\tau_d$ on the energy of the injected electrons, by calculation. FIGS. 2A and 2B show the results of the calculation.

Hereupon, the effect of multiple scattering of the electron beams is minutely evaluated, and the expansion of the beams is calculated. Accordingly, it was understood that if the energy of the injected electron beams is 15 MeV, beam size $\sigma_T$ is as large as about 7 mm. It was also understood that the Touschek lifetime and beam lifetime are 1,000 seconds or more each. Thus, even though the energy of the injected electron beams is relatively low, the beam lifetime is relatively long.

FIG. 2B indicates that the radiation damping time is as short as about 35 seconds when the injected electron beams are at 15 MeV.

Thus, when the deflecting magnetic fields are applied by means of the superconducting magnets, and if electron beams of relatively low energy of, e.g., 15 MeV are injected into the accelerating ring, radiation damping time $\tau_d$ is as short as about 35 seconds. When accumulated electron current is 1 A, moreover, beam lifetime $\tau_T$ is relatively long, i.e., 1,000 seconds or more. In other words, the radiation damping time is much shorter than the beam lifetime. Accordingly, electron beams can be injected a number of times after the betatron oscillation of the previously injected electron beams is subjected to full radiation damping. Therefore, the electron beams can be injected a plurality of times before the lifetime of the injected beams terminates. Thus, the electron beams can be injected in a multiplex manner even if the beam energy is low. Even though the beam energy is relatively low, therefore, the accumulated electron current can be increased to a predetermined value. Thus, an electron synchrotron apparatus can be provided which can produce a predetermined amount of synchrotron orbit radiations despite its compactness.

Let it be supposed, for example, that the repetition cycle of beam injection is 60 seconds, electron beams of 200 mA are injected at 15 MeV energy for each cycle, and the injection is repeated five times. In this case, accumulated electron current of about 1A can be obtained.

The following is a description of a method for operating electron synchrotron accelerating apparatus 10.

The inside of accelerating ring 11 is exhausted to a degree of vacuum of about $10^{-9}$. Thereafter, superconducting magnets 14 and 15 are excited so that the deflecting magnetic field intensity is the value on the injection i.e., 0.1 T. Then, the electron beams, preliminarily accelerated to, e.g., 15 MeV, are injected in a multiturn mode into ring 11 for a predetermined period of time (approximately 1 microsecond) by means of electron injector 17. Plus electromagnet 13 is excited while the electron beams are being injected.

Under the influence of the pulse magnetic field generated by pulse electromagnet 13, the injected electron beams are subjected to betatron oscillation around injection equilibrium orbit 18. As the intensity of the pulse magnetic field is reduced gradually, the electron beams for a number of revolution are injected into the accelerating ring. As the pulse magnetic field is reduced gradually, the injection equilibrium orbit approaches and finally overlaps central orbit 19. As a result, the electron beams stably move along the central orbit, and the amplitude of the betatron oscillation is subjected to gradual radiation damping.

Figure 3A:
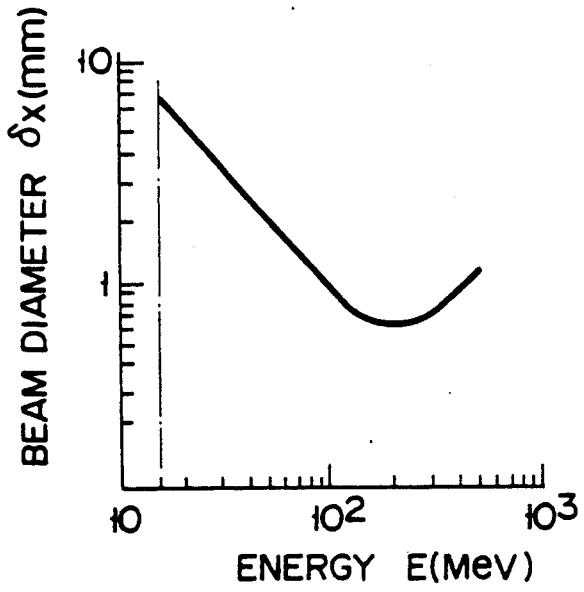
FIG. 3A is a graph showing the dependence of the beam size on the injected electron energy, observed when superconducting magnets are used as the sources of deflecting magnetic fields.
Figure 3B:
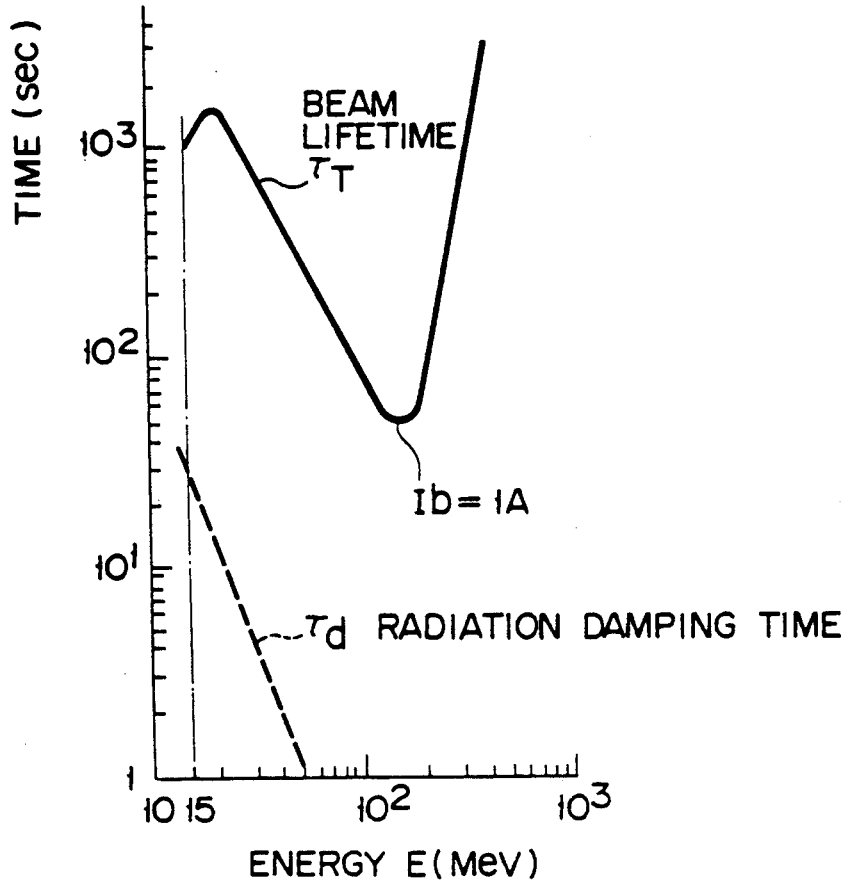
FIG. 3B is a graph showing the dependence of the beam lifetime and the radiation damping time on the injected electron energy, observed when the superconducting magnets are used as the sources of deflecting magnetic fields.

As seen from FIG. 3B, the betatron oscillation is damped 1/e in about 35 seconds after the end of the multirevolution injection. Sixty seconds after the end of the multi-turn injection, therefore, the electron beams are injected again from injector 17 through the aforesaid procedure. As mentioned before, beam lifetime $\tau_T$ is much longer than radiation damping time $\tau_d$. On and after this point of time, therefor, the electron beams are injected a predetermined number of times in the multiturn mode, in accordance with the above cycles. Thus, electrons are accumulated along the central orbit, so that the accumulated electron current is increased to 1A. Thereafter, the accumulated electron current is accelerated by means of hihg-frequency accelerating cavity 12.

Even though the energy of the injected electron beams is low, therefore, the accumulated electron current is increased to the predetermined value, and is accelerated to a predetermined level.

Figure 4:
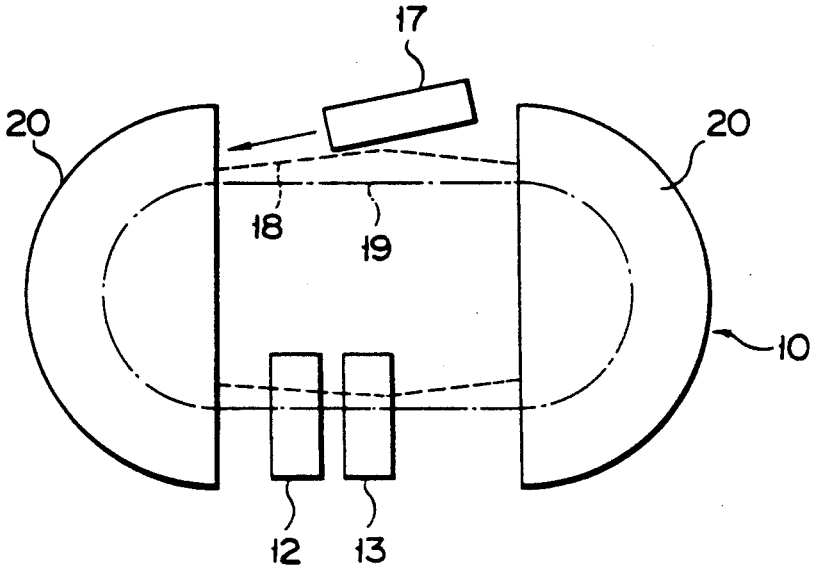
FIG. 4, is a schematic view of an electron synchrotron accelerating apparatus whose accelerating ring is shaped like a race track.

FIG. 4 shows a modification of the present invention. In this modification, the accelerating ring is shaped like a race track. In FIG. 4, the ring is not illustrated, and only injection equilibrium orbit 18 and central orbit 19 are shown. Two superconducting magnets 20 are arranged so as to be able to apply deflecting magnetic fields inside the accelerating ring.

Thus, also in the case of this modification, deflecting magnetic fields of high intensity are applied inside the accelerating ring by means of the superconducting magnets. Even though the energy of the injected electron beams is relatively low, therefore, radiation damping time $\tau_d$ is much shorter than the beam lifetime. Also, the accelerating ring may be shaped like a curved triangle or a curved square.

What is claimed is:

1. An electron synchrotron accelerating apparatus comprising:

an accelerating orbit;

a superconducting magnet for applying deflecting magnetic fields in the accelerating orbit; and an electron injector for injecting low-energy electron beams of 40 MeV or less into the accelerating orbit, said electron injector being adapted to inject the electron beams a plurality of times for each predetermined period of time, wherein the radiation damping time is shorter than the beam lifetime, so that the electron beams are injected a plurality of times before the lifetime of the injected electron beams terminates, whereby the electron beams are accumulated, and accumulated electron current is increased to a predetermined value.

2. The electron synchrotron accelerating apparatus according to claim 1, wherein said accelerating orbit is circular in shape.

3. The electron synchrotron accelerating apparatus according to claim 1, wherein said accelerating orbit is shaped like a race track.

4. A method for operating an electron synchrotron accelerating apparatus which includes an accelerating orbit, a superconducting magnet for applying deflecting magnetic fields in the accelerating orbit, and an electron injector for injecting low-energy electron beams of 40 MeV or less into the accelerating ring, said operating method comprising step of:

injecting the low-energy electron beams of 40 MeV or less a plurality of times for each predetermined period of time, by means of the electron injector, wherein the radiation damping time is shorter than the beam lifetime, so that the electron beams are injected a plurality of times before the lifetime of the injected electron beams terminates, whereby the electron beams are accumulated, and accumulated electron current is increased to a predetermined value.

5. The method according to claim 4, wherein said accelerating orbit is shaped like a race track.

* * * * *